US006347662B1

(12) United States Patent
Davidian et al.

(10) Patent No.: US 6,347,662 B1
(45) Date of Patent: Feb. 19, 2002

(54) HEAT EXCHANGER, IN PARTICULAR PLATE HEAT EXCHANGER FOR AN AIR SEPARATION UNIT

(75) Inventors: Benoît Davidian; Marc Wagner, both of Saint Maur des Fossés (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/495,700

(22) Filed: Feb. 1, 2000

(30) Foreign Application Priority Data

Feb. 1, 1999 (FR) ..... 99 01098

(51) Int. Cl.[7] ..... F28F 3/00

(52) U.S. Cl. ..... 165/166; 165/167; 165/146; 165/170

(58) Field of Search ..... 165/111, 166, 165/167, DIG. 183, 170, 146; 96/185; 137/561 A

(56) References Cited

U.S. PATENT DOCUMENTS

| | | | | | |
|---|---|---|---|---|---|
| 3,552,488 A | | 1/1971 | Grill et al. | | |
| 4,715,433 A | | 12/1987 | Schwarz et al. | | |
| 4,890,670 A | * | 1/1990 | Schiessl | | 165/166 |
| 6,032,731 A | * | 3/2000 | Grunditz | | 165/166 |
| 6,044,902 A | * | 4/2000 | Pahade et al. | | 165/165 |
| 6,073,685 A | * | 6/2000 | Gerard et al. | | 165/111 |
| 6,076,598 A | * | 6/2000 | Doi et al. | | 165/166 |
| 6,089,313 A | * | 7/2000 | Levy et al. | | 165/140 |

FOREIGN PATENT DOCUMENTS

| | | | | |
|---|---|---|---|---|
| EP | 0 578 218 | | 1/1994 | |
| EP | 718582 | * | 6/1996 | 165/166 |
| WO | 95/28610 | * | 10/1995 | 165/166 |

* cited by examiner

*Primary Examiner*—Ira S. Lazarus
*Assistant Examiner*—Terrell McKinnon
(74) *Attorney, Agent, or Firm*—Young & Thompson

(57) ABSTRACT

An exchanger comprises a plurality of plates (8) made of copper, nickel or aluminium or an alloy of these metals, which are separated by exchange corrugations made of copper or a copper alloy (6) and two outer sheets (7). The distance between the plates is more than 6 mm, optionally 8 mm.

10 Claims, 4 Drawing Sheets

HEAT EXCHANGER, IN PARTICULAR PLATE HEAT EXCHANGER FOR AN AIR SEPARATION UNIT

FIELD OF THE INVENTION

The present invention relates to a a heat exchanger and, more particularly, to a plate heat exchanger, for exchanging heat between at least two fluids in an air separation unit.

BACKGROUND OF THE INVENTION

An air separation unit comprises several types of heat exchanger.

A main heat exchanger is used to cool the feed air of the unit to the distillation temperature by exchanging heat with one or more fluids coming from the distillation unit. In certain cases, these are pressurized liquids from the unit which vaporize in exchange with the air to be distilled in the exchanger. These exchangers are normally made entirely of aluminium or copper or alloys of these metals (WO95/28610, Hausen, Linde "Tieftemperaturtechnik", pages 468–471, "Large Tonnage Oxygen Plants—Brazed Aluminium Technology and Equipment for the 80s", Duncan et al., Cryogenic Processes and Equipment Conference, ASME, August 1980, "Improved Plant Main Condenser", O'Neill et al., Cryogenic Processes and Equipment Conference, ASME, August 1980).

For safety reasons, these liquids are sometimes vaporized in a special exchanger in exchange with a single fluid such as air or nitrogen.

The unit also comprises at least one vaporizer-condenser, which is a heat exchanger placed inside or outside the column. These vaporizers are normally made entirely of copper, stainless steel, nickel or aluminium and consist of at least two circuits, including at least one which is connected to the rest of the plant by means of pipes welded to the equipment.

These exchangers usually comprise a plurality of aluminium plates separated from one another by between 5 and 7.6 mm (U.S. Pat. No. 4,715,433) with aluminium corrugations between the plates.

In EP-A-0 952 419, the distance between the aluminium plates is at most 5 mm.

At cryogenic temperatures, the thermal conductivity of copper is about three times higher than that of aluminium. The height of the corrugations (and therefore the distance between the plates) can hence be increased in order to improve the heat exchange and the number of plates will be reduced, as illustrated in FIG. 7. FIG. 7 shows the change in the effective area as a function of corrugation height for various materials and at different temperatures. The effective area corresponds to the primary area (separating sheets) plus the secondary area (corrugations) corrected by a fin coefficient.

SUMMARY OF THE INVENTION

According to one object of the invention, a plate heat exchanger is provided, comprising:

a plurality of metal plates made of copper, nickel, aluminium or an alloy comprising at least 80% copper, at least 80% nickel or at least 80% aluminium, which have a substantially similar contour, are parallel and are spaced apart from one another in order to form passages;

exchange corrugations comprising at least 80% copper, which are placed between at least two plates, a closure means consisting of side bars connected to the edges of the plates in a leaktight fashion;

two outer sheets which are parallel to the plates and of a contour substantially similar to those of the plates;

optionally, semicylindrical heads connected to the passages between the plates, and, optionally, a fluid inlet/outlet chamber connected at a leaktight joint to a fluid inlet or outlet face, at least some of the chamber consisting of at least one sphere or ellipsoid portion and of sections of cones tangential to this sphere or ellipsoid portion characterized in that the distance between the adjacent edges of the plates, between which corrugations made of at least 80% copper are placed, is more than 6 mm, optionally 8 mm.

The distance between the adjacent edges of the plates is preferably more than 9 mm or 10 mm.

The thickness of the plates varies from 1 mm to 25 mm.

The thickness of the corrugations varies from 0.1 mm to 0.4 mm.

The frequency of the corrugations varies from 300 corrugations/meter to 1200 corrugations/meter.

All the corrugations of the exchanger are preferably made of copper.

The exchanger may fulfil one of the roles described above in an air separation unit.

For example, it may be the main exchanger which is used to cool the air to its distillation temperature or a subcooler.

If the unit comprises a first column which is fed with air and is thermally connected to a second column, a heat exchanger according to the invention may make it possible to heat the base of the second column with the head gas from the first column. Only two different flows circulate through the exchanger.

Alternatively, the heat exchanger according to the invention may be an intermediate exchanger of the second column or a head condenser of a single column.

BRIEF DESCRIPTION OF THE DRAWINGS

An illustrative embodiment of the invention will now be described with reference to the appended drawings.

In these drawings.

DETAILED DESCRIPTION OF THE PREFERRED EMBODIMENTS

Figure 1:
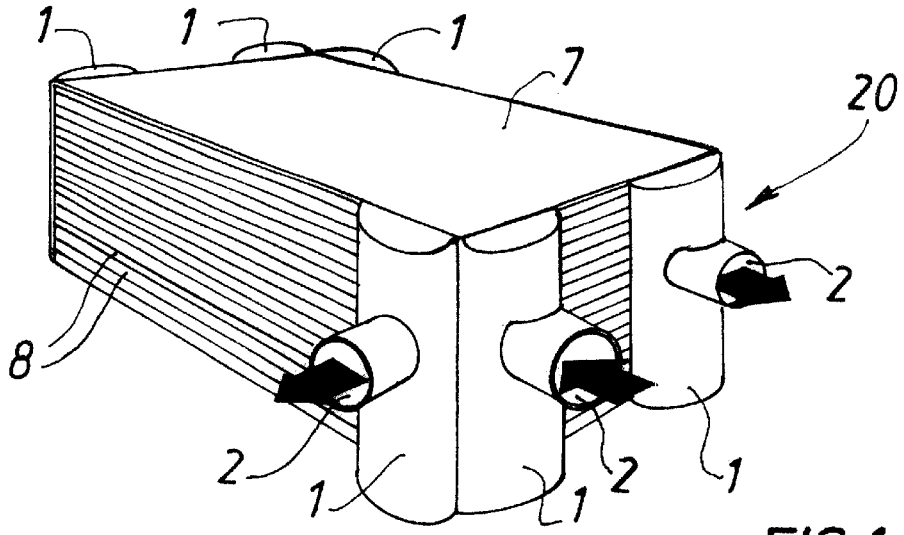
FIG. 1 is a diagrammatic view of the outside of an exchanger according to the invention.

In FIG. 1, a heat exchanger 20 comprises a series of parallel plates made of aluminium which are brazed to one another and define a multitude of passages intended alternately for one of three fluid flows, for example a flow of air gas, a gas flow enriched with nitrogen at about 5 bar and a liquid flow enriched with oxygen at about 1.5 bar. Clearly, the pressures may take other values.

The gas or the liquid enters the exchanger through a pipe 2 made of stainless steel welded to the middle of a semi-cylindrical head 1 (or header) made of stainless steel which distributes the gas over the full height of the exchanger 20 so as to send it to a passage inlet defined by the separating bar 12 made of stainless steel.

Figure 2:
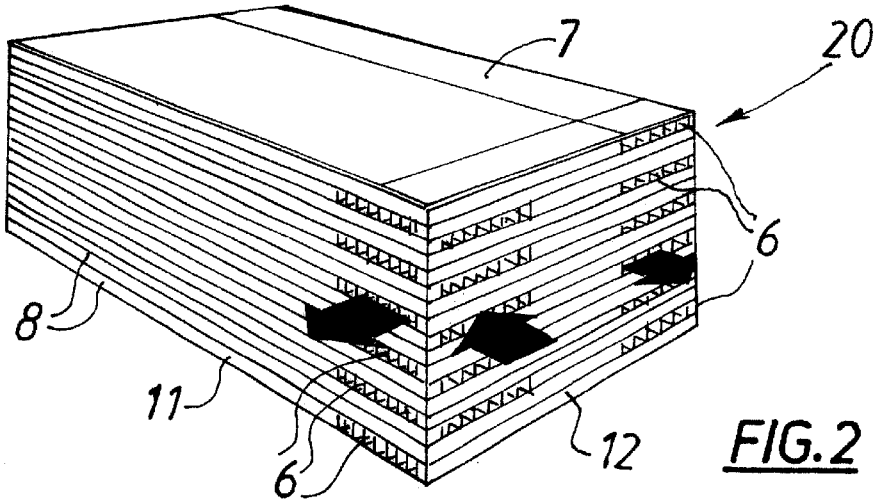
FIGS. 2 and 3 are diagrammatic views of the inside of an exchanger according to the invention
Figure 3:
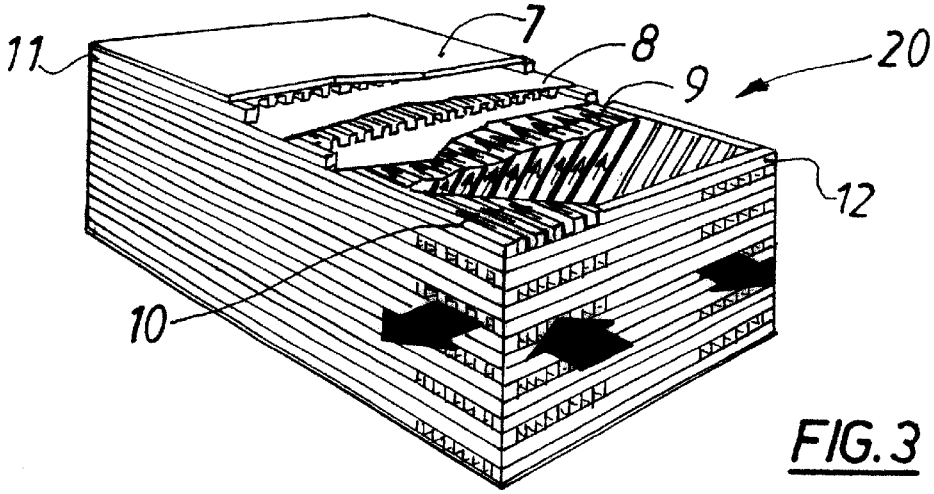

FIG. 2 shows the outer sheet 7 made of stainless steel above the stacked plates 8. Another identical outer sheet is placed below the plates. Side bars 11 made of stainless steel are fixed to the edges of the plates 8 in a leaktight manner.

There parallel plates 8, whose shape is rectangular, are separated by corrugations 6 made of copper or an alloy comprising at lest 80% copper which are fixed by brazing. The distance between the adjacent edges of the plates is constant and equal to 9.6 mm with 1.8 mm thick plates. The height of the corrugations is 9.63 mm.

With this dimensioning, the number of plates is halved compared with the number used with a conventional 5 mm separation. The amount of brazing filler material will also be reduced.

Above the corrugations 6, the passages are closed by bars 12.

Figure 4:
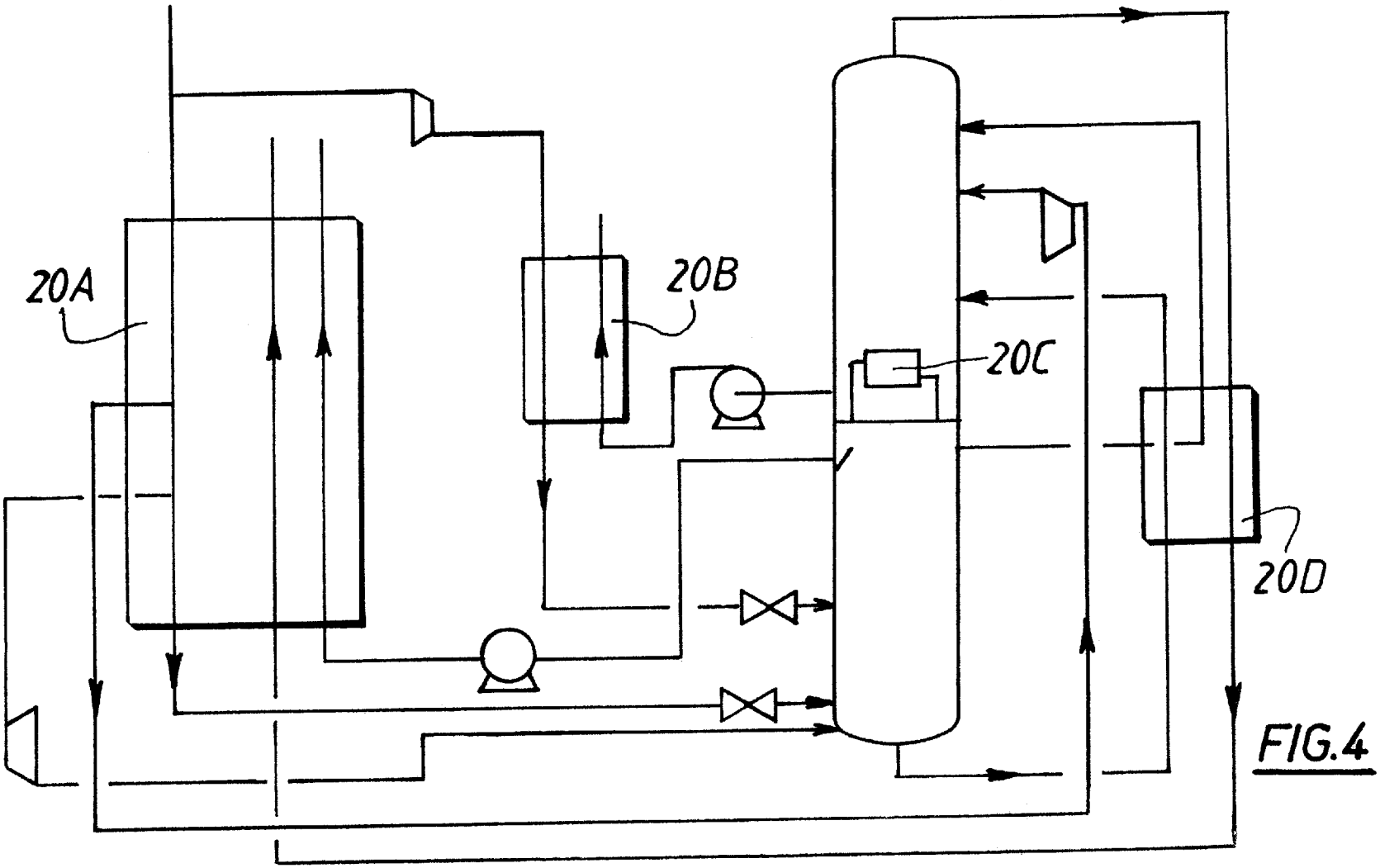
FIG. 4 is an air separation unit comprising a plurality of exchangers according to the invention.

In FIG. 4, an air flow cools in an exchanger 20A according to the invention by exchanging heat with residual gases, liquid nitrogen and nitrogen gas before being sent to a double column. The latter comprises a medium-pressure column thermally connected to a low-pressure column by a vaporizer-condenser 20C according to the invention.

An oxygen-rich liquid flow is drawn from the base of the low-pressure column and vaporizes by exchanging heat with a supercharged air flow in a special exchanger 20B according to the invention.

Other flows in the unit are subcooled in an exchanger 20D according to the invention.

Figure 5:
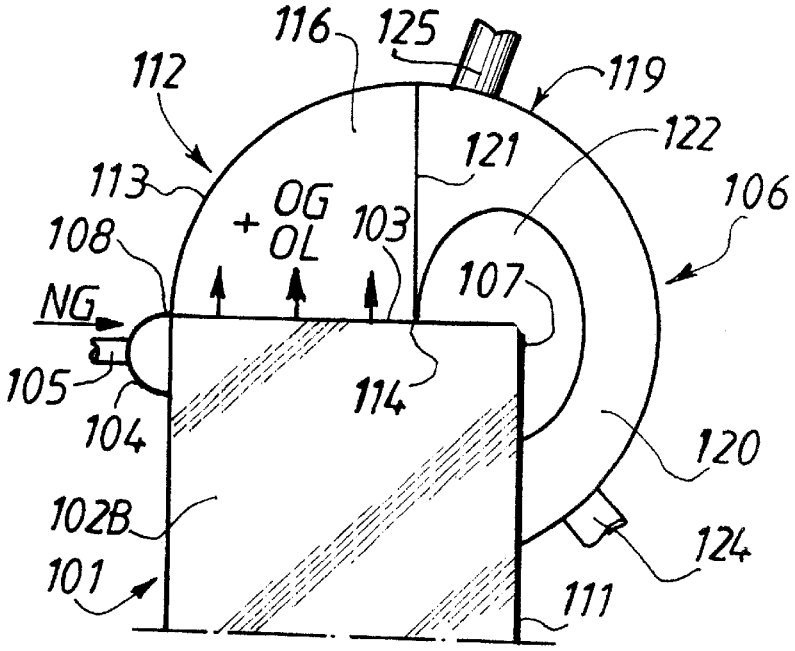
FIG. 5 is a partial side view of the outside of another exchanger according to the invention.
Figure 6:
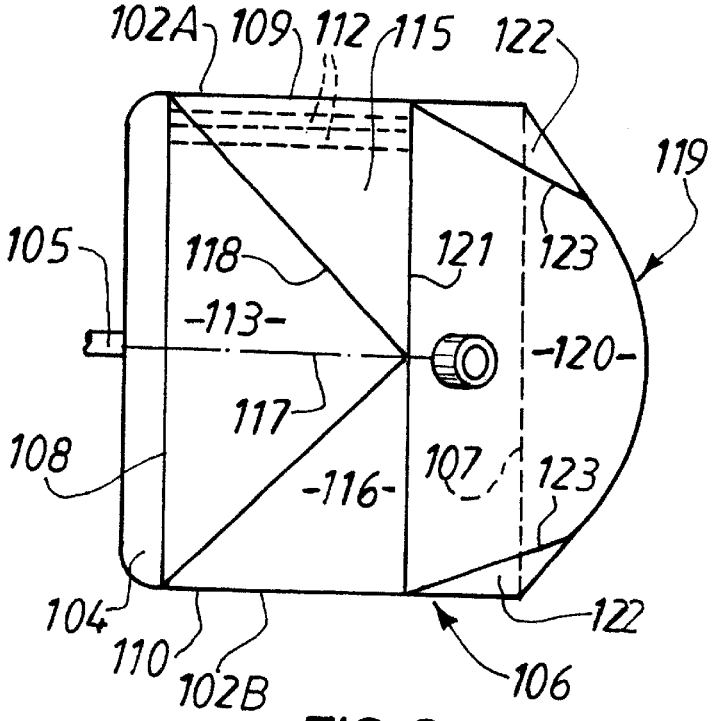
FIG. 6 is a plan view of this exchanger.
Figure 7:
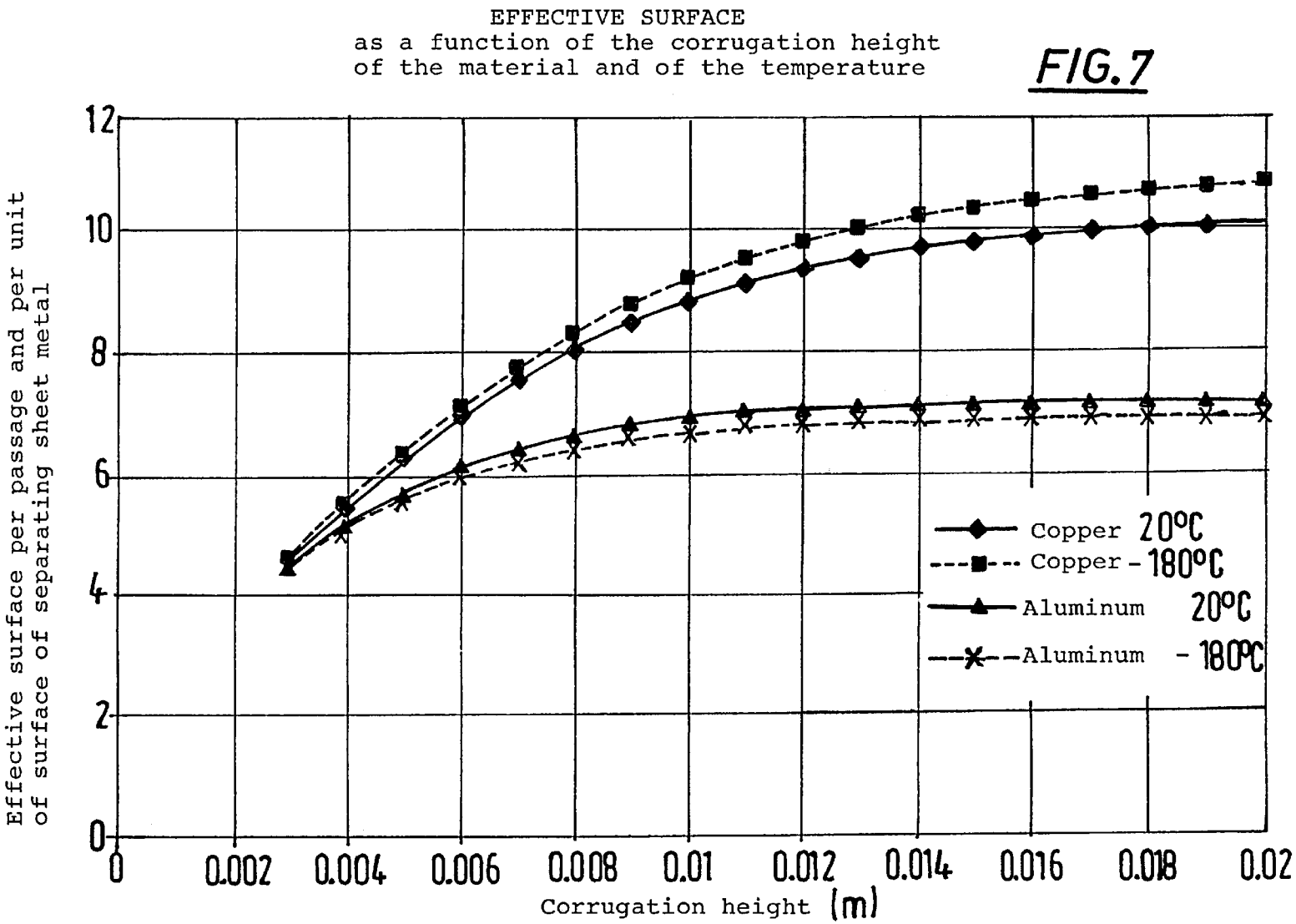
FIG. 7 shows the change in the effective area as a function of corrugation height for various materials and at different temperatures. The effective area corresponds to the primary area (separating sheets) plus the secondary area (corrugations) corrected by a fin coefficient.

In FIG. 5, the exchanger comprises a stack of vertical and parallel rectangular plates between which spacer corrugations that also form thermal fins are interposed. Each pair of plates delimits a passage of flat overall shape. There are at least two series of passages, one of which is reserved for the circulation of oxygen, which is the fluid being treated, while the other is used to circulate nitrogen, which is the auxiliary fluid generating heat during condensation.

On their periphery, the passages are closed by bars. The bars corresponding to the fluid being treated are, however, removed on the upper face 103 of the body 101, and also on its lower face. The exchanger thus operates by the thermosiphon principle, with upward circulation of vaporized oxygen entraining liquid oxygen. The diphasic mixture leaves the body 102 through its upper face 103.

The closure bars are furthermore arranged in such a way as to leave horizontal rows of nitrogen inlet-outlet windows free on the vertical side faces of the body 101. These windows are covered by inlet-outlet headers of cylindrical overall shape, such as the header 104 represented in the drawing, provided at the upper part of the body and used for the admission of nitrogen gas into the nitrogen passages, which header is fed by a line 105.

The ball constituting the fluid inlet-outlet chamber may be made of stainless steel or nickel or an alloy comprising of one of these two metals.

These chambers are described in more detail in EP-A-0 718 582 and EP-A-0 718 583.

Hence, in FIG. 4, the liquid oxygen vaporizes after pressurization in the exchanger 20B in exchange with air, and the pressurized liquid nitrogen vaporizes in the main exchanger 20A in exchange with air. The air is expended in a Claude turbine and/or a blower turbine. Argon may be produced from the flow coming from the low-pressure column.

The exchangers according to the invention may be co-current or countercurrent exchangers. They may be vaporizers of the bath (thermosiphon) or film type. The channels may be of rectangular section, or cylindrical or a combination of these two.

What is claimed is:

1. Heat exchanger comprising:

a plurality of metal plates made of copper, nickel, aluminium or an alloy comprising at least 80% copper, at least 80% nickel or at least 80% aluminium, which have a substantially similar contour, are parallel and are spaced apart from one another in order to form passages;

exchange corrugations comprising at least 80% copper, which are placed between at least two of the plates;

a closure means consisting of side bars connected to the edges of the plates in a leaktight fashion;

two outer sheets which are parallel to the plates and of a contour substantially similar to those of the plates;

wherein the distance between the adjacent edges of the plates, between which the corrugations made of at least 80% copper are placed, is more than 8 mm.

2. Exchanger according to claim 1, in which the distance between the plates is more than 10 mm.

3. Exchanger according to claim 1, in which all the corrugations are made of copper or a copper alloy.

4. Exchanger according to claim 1, further comprising semicylindrical heads connected to the passages between the plates.

5. Exchanger according to claim 1, further comprising a fluid inlet/outlet chamber connected at a leaktight joint to a fluid inlet or outlet face, at least some of the chamber consisting of at least one sphere or ellipsoid portion and of sections of cones to this sphere or ellipsoid portion.

6. Unit for separation by cryogenic distillation, comprising at least one heat exchanger according to claim 1.

7. Separation unit according to claim 6, in which air is separated.

8. Unit according to claim 7, in which the heat exchanger is the main exchanger which is used to cool the air to its distillation temperature.

9. Unit according to claim 6, in which the heat exchanger is a subcooler.

10. Unit according to claim 6, comprising a first column, which is fed with air and is thermally connected to a second column by means of said at least one heat exchanger.

* * * * *